US008505886B2

(12) United States Patent
Yadorihara et al.

(10) Patent No.: US 8,505,886 B2
(45) Date of Patent: Aug. 13, 2013

(54) MULTISTAGE PRESSURE CONDENSER

(75) Inventors: Shun Yadorihara, Yokohama (JP); Koichi Yoshimura, Yokohama (JP); Takaaki Kezuka, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 332 days.

(21) Appl. No.: 12/819,513

(22) Filed: Jun. 21, 2010

(65) Prior Publication Data

US 2010/0329896 A1 Dec. 30, 2010

(30) Foreign Application Priority Data

Jun. 24, 2009 (JP) ..... 2009-150041

(51) Int. Cl.
*B01F 3/04* (2006.01)

(52) U.S. Cl.
USPC ..... 261/147; 261/152; 261/113; 261/DIG. 10

(58) Field of Classification Search
USPC ..... 261/147, 152, 155, 113, DIG. 10, 261/DIG. 76
See application file for complete search history.

(56) References Cited

U.S. PATENT DOCUMENTS

| | | | | |
|---|---|---|---|---|
| 3,817,323 | A * | 6/1974 | Ebara et al. | 165/110 |
| 4,598,767 | A * | 7/1986 | Saleh | 165/113 |
| 6,814,345 | B2 | 11/2004 | Inoue | |
| 7,111,832 | B2 | 9/2006 | Inoue | |
| 8,360,402 | B2 * | 1/2013 | Sugitani et al. | 261/113 |

FOREIGN PATENT DOCUMENTS

| | | |
|---|---|---|
| JP | 46-14489 | 4/1971 |
| JP | 47-26505 | 10/1972 |
| JP | 49-43734 | 4/1974 |
| JP | 59-21991 | 2/1984 |
| JP | 60-14096 | 1/1985 |
| JP | 6-257963 | 9/1994 |
| JP | 11-173768 | 7/1999 |
| JP | 2003-148876 | 5/2003 |
| JP | 3706571 | 8/2005 |
| JP | 2009-52867 A | 3/2009 |
| JP | 2009-97788 | 5/2009 |
| WO | WO2009/075300 A1 | 6/2009 |

OTHER PUBLICATIONS

Notification for Filing Opinion issued Jan. 19, 2012 in Korean Patent Application No. 10-2010-59391 (with English translation).
Canadian Office Action issues Mar. 23, 2012 in Patent Application No. 2,708,210.
Office Action mailed Mar. 12, 2013 in Japanese Patent Application 2009-150041 filed Jun. 24, 2009 (with English translation)—5 pages.

* cited by examiner

*Primary Examiner* — Charles Bushey
(74) *Attorney, Agent, or Firm* — Oblon, Spivak, McClelland, Maier & Neustadt, L.L.P.

(57) ABSTRACT

According to one embodiment, there is provided a multi-stage-pressure condenser, including a first condenser, a second condenser and a third condenser, which are arranged in increasing order of internal pressure, the first condenser and the second condenser each including a first partition in which perforations from which condensate obtained by condensing turbine steam by cooling water drops are formed on a cooling water inflow side of the condenser rather than at a central part thereof, and a second partition which partitions a reheating room for reheating condensate dropping from the perforations in a direction perpendicular to an inflow direction of the cooling water, and a heating-steam flow path which supplies heated steam from the third condenser to the reheating room partitioned by the first partition and the second partition.

9 Claims, 6 Drawing Sheets

MULTISTAGE PRESSURE CONDENSER

CROSS-REFERENCE TO RELATED APPLICATIONS

This application is based upon and claims the benefit of priority from Japanese Patent Application No. 2009-150041, filed Jun. 24, 2009; the entire contents of which are incorporated herein by reference.

FIELD

Embodiments described herein relate generally to a multistage-pressure condenser for condensing steam into condensate.

BACKGROUND

Condensers that are applied to nuclear power plants, thermal power plants and the like, condense turbine exhaust steam, which has been expanded by a steam turbine, into condensate using cooling water. The condensate is supplied to a steam generator through feed-water heaters. The condensers are maintained under vacuum such that thermal energy of turbine exhaust steam can be collected as much as possible when the turbine exhaust steam is condensed into condensate. A condenser that is maintained under vacuum to condense turbine exhaust steam into condensate usually has a steam turbine on its head side.

As the vacuum of a condenser becomes high, the output of a steam turbine increases to improve plant efficiency, while as the temperature of condensate condensed by a condenser becomes high when the condensate is supplied to feed-water heaters, plant efficiency improves. As a system that is effective in improving plant efficiency, a multistage-pressure condenser (which is also called a multi-pressure condenser) including a plurality of condensers having different internal pressures has conventionally been used. The following are reasons why the multistage-pressure condenser can improve plant efficiency.

1) The average value of turbine exhaust steam pressures in a multi-pressure condenser is smaller than that in a single-pressure condenser including a plurality of condensers having the same pressure.

2) Condensate condensed by a low-pressure condenser and an intermediate-pressure condenser is caused to flow into a high-pressure condenser having a high saturation temperature and reheated. Thus, the high-temperature condensate can be supplied to feed-water heaters, with the result that the bleed amount of a steam turbine decreases and the output thereof increases.

3) A difference between the saturation temperature of each of the condensers and the temperature of the cooling water outlet thereof, namely, a difference in termination temperature can be widened. Accordingly, the cooling area of the condensers can be reduced.

A method of heating condensate of a low-pressure condenser by steam of a high-pressure condenser is disclosed in, for example, Japanese Patent No. 3706571 (referred to as Patent Document 1 hereinafter) and Jpn. Pat. Appln. KOKAI Publication No. 11-173768 (referred to as Patent Document 2 hereinafter).

The condenser of Patent Document 1 has the following feature. A regeneration room of a low-pressure condenser, which is partitioned by a pressure partition of a perforated plate, includes a tray. Condensate that drops into the tray from the pressure partition is heated using steam from a high-pressure condenser, and condensate that overflows into the regeneration room from the tray is circulated, with the result that surface turbulent flow heat transmission occurs on the surface of the condensate.

In Patent Document 1, however, since the tray is provided under the perforated plate, the internal structure of the condensers is complicated and thus a time for manufacturing the condensers is lengthened. Though Patent Document 1 discloses using a circulating-flow forming promotion means for condensing steam into condensate by a low-pressure condenser, it does not disclose a method of bringing steam supplied from a high-pressure condenser and condensate condensed by a low-pressure condenser into effective contact with each other. It is deemed that the steam and the condensate are not mixed together sufficiently.

The condenser of Patent Document 2 has the following feature. A perforated plate is provided on the bottom of the hot well of a low-pressure condenser. A conical obstruction is arranged with its top upward such that condensate drops from the small holes of the perforated plate to the center of the top of the conical obstruction. The condensate contacts the conical obstruction to form a liquid film.

In Patent Document 2, however, since the conical obstruction is provided under the perforated plate, the structure is complicated, which increases an operation step such as welding and lengthens a manufacturing time.

Though a number of proposals are made to reheat the condensate of a multistage-pressure condenser, a structure for the reheating is complicated, and condensate of a low-pressure condenser and steam supplied from a high-pressure condenser are not mixed together effectively.

It is thus desired to propose a multistage-pressure condenser capable of simplifying a structure for reheating of condensate and effectively mixing condensate of a low-pressure condenser and steam supplied from a high-pressure condenser together.

DETAILED DESCRIPTION

Embodiments of the invention will be described below with reference to the drawings. In general, according to one embodiment, there is provided a multistage-pressure condenser, including: a first condenser, a second condenser and a third condenser, which are arranged in increasing order of internal pressure, the first condenser and the second condenser each including a first partition in which perforations from which condensate obtained by condensing turbine steam by cooling water drops are formed on a cooling water inflow side of the condenser rather than at a central part thereof, and a second partition which partitions a reheating room for reheating condensate dropping from the perforations in a direction perpendicular to an inflow direction of the cooling water; and a heating-steam flow path which supplies heated steam from the third condenser to the reheating room partitioned by the first partition and the second partition.

FIRST EMBODIMENT

Figure 1:
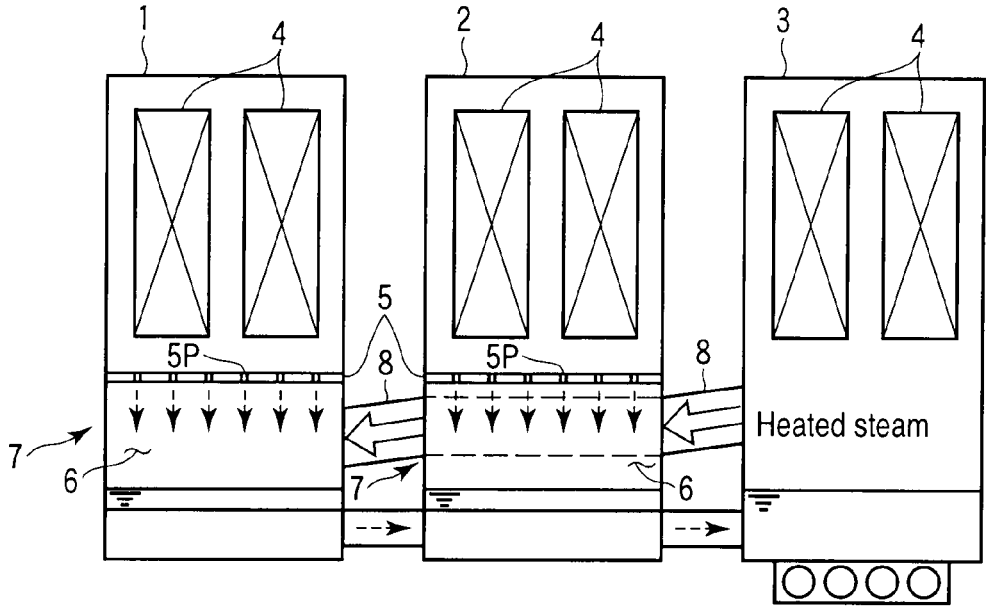
FIG. 1 is a front view of a multistage-pressure condenser according to a first embodiment.
Figure 2:
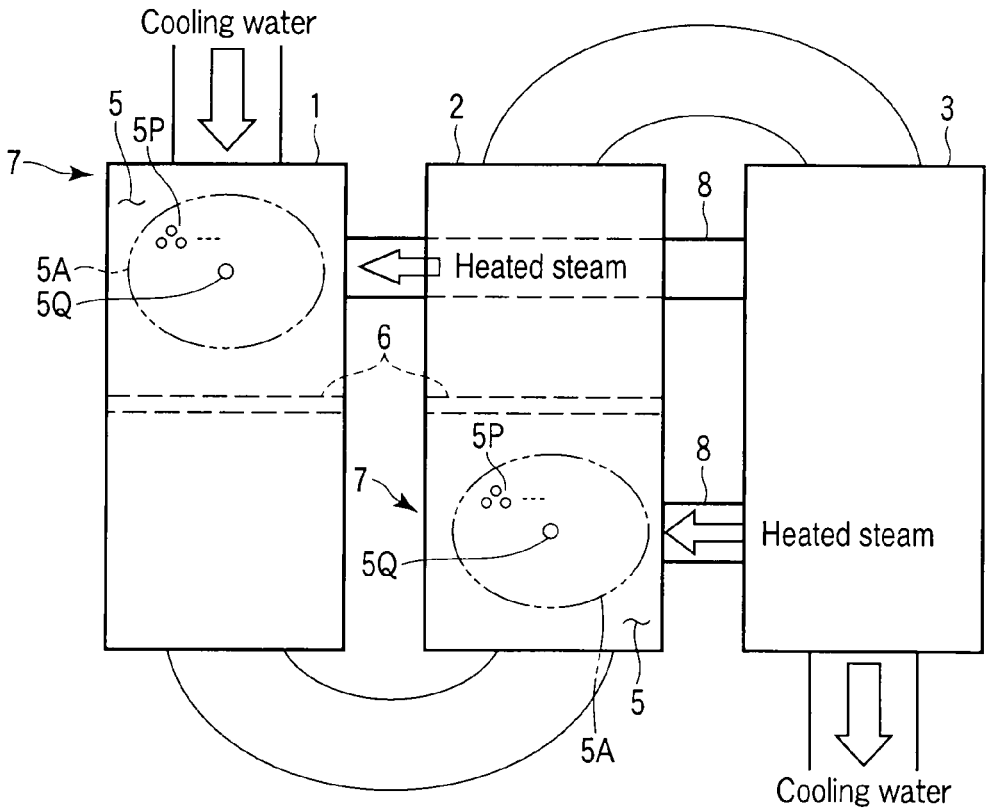
FIG. 2 is a top view of the multistage-pressure condenser according to the first embodiment.

Referring first to FIGS. 1 and 2, a first embodiment will be described.

FIG. 1 is a front view of a multistage-pressure condenser according to a first embodiment. FIG. 2 is a top view of the multistage-pressure condenser. In each of these figures, the internal main parts which cannot be viewed from the outside are shown for easy understanding of the technical features.

The multistage-pressure condenser according to the first embodiment includes a low-pressure condenser 1, an intermediate-pressure condenser 2 and a high-pressure condenser 3, which are arranged in increasing order of internal pressure. The low-pressure condenser 1, intermediate-pressure condenser 2 and high-pressure condenser 3 condense turbine exhaust steams, which have been expanded by a low-pressure steam turbine, an intermediate-pressure steam turbine and a high-pressure steam turbine, none of which is shown, into condensate using cooling water.

Each of the low-pressure condenser 1, intermediate-pressure condenser 2 and high-pressure condenser 3 is provided with cooling water tubes 4 through which cooling water flows. First, the cooling water flows into the cooling water tubes 4 of the low-pressure condenser 1 from outside the multistage-pressure condenser. The cooling water overflows from the cooling water tubes 4 of the condenser 1 and then flows into the cooling water tubes 4 of the intermediate-pressure condenser 2 through a U-shaped pipe. The cooling water overflows from the cooling water tubes 4 of the condenser 2 and then flows into the cooling water tubes 4 of the high-pressure condenser 3 through the U-shaped pipe. Finally, the cooling water overflows from the cooling water tubes 4 of the condenser 3.

The low-pressure condenser 1 and intermediate-pressure condenser 2 each include a perforated plate (first partition) 5 serving as a pressure partition, a condensate partition (second partition) 6 and a reheating room 7. The high-pressure condenser 3 includes none of these partitions 5, 6 and 7 and its structure is simplified.

A heating-steam flow path 8 is provided between the low-pressure condenser 1 and intermediate-pressure condenser 2 and between the intermediate-pressure condenser 2 and high-pressure condenser 3. More specifically, the heating-steam flow path 8 includes a flow path extending from the high-pressure condenser 3 to the low-pressure condenser 1 through the intermediate-pressure condenser 2 and a flow path extending from the high-pressure condenser 3 to the intermediate-pressure condenser 2. With this structure, the heating-steam flow path 8 can supply heated steam from the high-pressure condenser 3 to the reheating room 7 of each of the intermediate-pressure condenser 2 and low-pressure condenser 1 effectively at the shortest distance.

The heating-steam flow path 8 is inclined between the high-pressure condenser 3 and the intermediate-pressure condenser 2 and between the intermediate-pressure condenser 2 and the low-pressure condenser 1. This inclination allows heated steam to flow into a destination smoothly even though part of the heated steam is condensed halfway through the flow path.

Unlike the conventional perforated plates, the perforated plate 5 of each of the low-pressure and intermediate-pressure condensers 1 and 2 have perforations 5P on its cooling water inflow side rather than its central part, the perforations 5P being used to drop condensate into which turbine exhaust steam is condensed using cooling water flowing into the condenser. More specifically, on the perforated plate 5, no perforations are formed in a region from the condensate partition 6 to the cooling water outflow side, whereas the perforations 5P are formed at regular intervals in a region 5A from the condensate partition 6 to the cooling water inflow side. Since the perforations 5P are formed in the region 5A so limited, the heated steam supplied from the high-pressure condenser 3 is brought into direct and enough contact with the condensate that drops from the perforations 5P.

The condensate partition 6 is a partition that partitions a reheating room for reheating condensate dropping from the perforations 5P in a direction perpendicular to the inflow direction of cooling water. Thus, the reheating room 7 is formed more narrowly by the perforated plate 5 and condensate partition 6 than the reheating rooms of the conventional condensers. This reheating room 7 allows heated steam supplied from the high-pressure condenser 3 and condensate dropping from the perforations 5P to be mixed equally. Since the reheating room 7 in the intermediate-pressure condenser 2 and the heating-steam flow path 8 that extends through the intermediate-pressure condenser 2 are provided in different spaces, the condensate dropping from the perforations 5P does not contact the heating-steam flow path 8 thereby to prevent heated steam which flows through the heating-steam flow path 8 from being cooled.

A vent 5Q is formed in the center of the region 5A occupied by the perforations 5P to cause heated steam to flow from below to above due to a difference in pressure between the upper and lower parts of the perforated plate 5. An umbrella for avoiding condensate can be provided above the vent 5Q. The vent 5Q is formed within the region 5A; thus, while heated steam is being guided into the vent 5Q from the high-pressure condenser 3, it is brought into enough contact with all the condensate dropping from the perforated plate 5 to promote a mixture of the heated steam and the condensate.

In the multistage-pressure condenser so constructed, when cooling water flows through the cooling water tubes 4 of the low-pressure condenser 1, intermediate-pressure condenser 2 and high-pressure condenser 3 in sequence, steam-turbine exhaust steam is cooled and condensate drops into each of the condensers. In the low-pressure and intermediate-pressure condensers 1 and 2, condensate drops into the reheating room 7 from the perforations 5P formed in the region 5A of the perforated plate 5. In the high-pressure condenser 3, heated steam flows into the heating rooms 7 of the low-pressure and intermediate-pressure condensers 1 and 2 through the heating-steam flow path 8. While the heated steam is being guided into the vent 5Q, it is brought into enough contact with all the condensate that drops from the perforated plate 5 to promote a mixture of the heated steam and the condensate. The condensate reheated effectively in the low-pressure and intermediate-pressure condensers 1 and 2 are stored in their respective liquid phase unit, and supplied to a liquid phase unit of the high-pressure condenser 3 and then to feed-water heaters (not shown) under high-temperature conditions.

According to the first embodiment, while the internal structure of the multistage-pressure condenser is simplified, condensate dropping in the low-pressure and intermediate-pressure condensers 1 and 2 can be effectively mixed with heated steam supplied from the high-pressure condenser 3 to increase the temperature of the condensate in the low-pressure and intermediate-pressure condensers 1 and 2. Hence, high-temperature condensate can be supplied to the feed-water heaters, a bleed amount of the steam turbine used for heating condensate in the feed-water heaters can be reduced, and the output of a generator can be increased.

According to the first embodiment, the heating-steam flow path 8 includes a flow path extending from the high-pressure condenser 3 to the low-pressure condenser 1 through the intermediate-pressure condenser 2. Thus, heated steam of the high-pressure condenser 3 can be effectively supplied to the reheating room 7 of the low-pressure condenser 1 at the shortest distance.

According to the first embodiment, the heating-steam flow path 8 is inclined between the high-pressure condenser 3 and the intermediate-pressure condenser 2 and between the intermediate-pressure condenser 2 and the low-pressure condenser 1. This inclination allows heated steam to flow into a destination smoothly even though part of the heated steam is condensed halfway through the flow path.

According to the first embodiment, the perforated plate 5 has perforations 5P in its limited region 5A so limited. Thus, heated steam supplied from the high-pressure condenser 3 can be brought into direct and enough contact with all the condensate that drops from the perforations 5P.

According to the first embodiment, the reheating room 7 is formed more narrowly by the perforated plate 5 and condensate partition 6 than the reheating rooms of the conventional condensers. This reheating room 7 allows heated steam supplied from the high-pressure condenser 3 and condensate dropping from the perforations 5P to be mixed equally.

According to the first embodiment, the reheating room 7 in the intermediate-pressure condenser 2 and the heating-steam flow path 8 that extends through the intermediate-pressure condenser 2 are provided in different spaces. Therefore, the condensate dropping from the perforations 5P does not contact the heating-steam flow path 8 thereby to prevent heated steam which flows through the heating-steam flow path 8 from being cooled.

According to the first embodiment, while heated steam is being guided into the vent 5Q from the high-pressure condenser 3, it is brought into enough contact with all the condensate dropping from the perforated plate 5 to promote a mixture of the heated steam and the condensate.

SECOND EMBODIMENT

A second embodiment will be described below with reference to FIGS. 3 to 6. In the second embodiment, the elements corresponding to those of the first embodiment shown in FIGS. 1 and 2 are denoted by the same reference numerals and their descriptions are omitted, and elements different from those of the first embodiment will be described.

Figure 3:
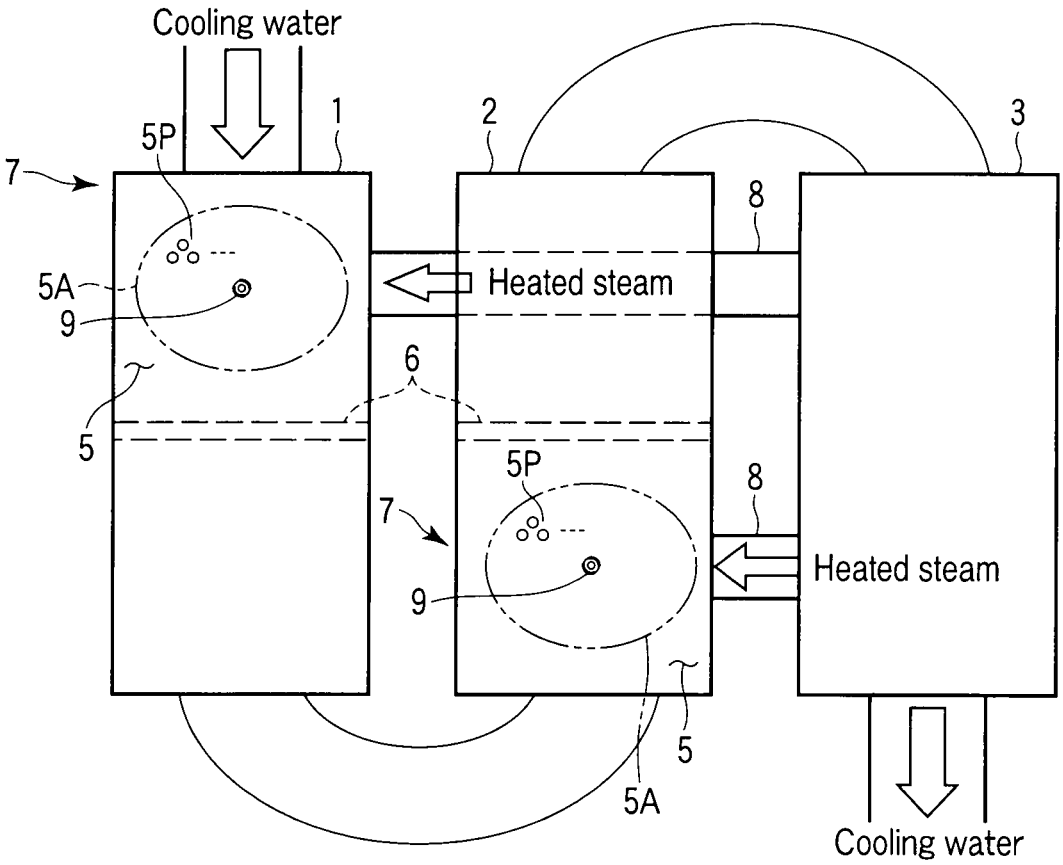
FIG. 3 is a top view of a multistage-pressure condenser according to a second embodiment.

FIG. 3 is a top view of a multistage-pressure condenser according to the second embodiment.

Figure 4A:
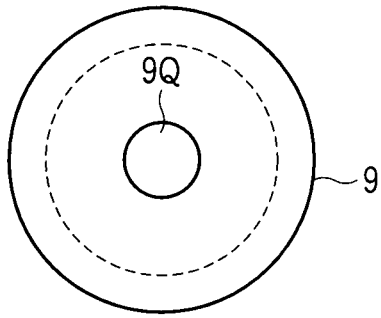
FIG. 4A is a top view of a vent tube having an orifice which is provided for the multistage-pressure condenser shown in FIG. 3.
Figure 4B:
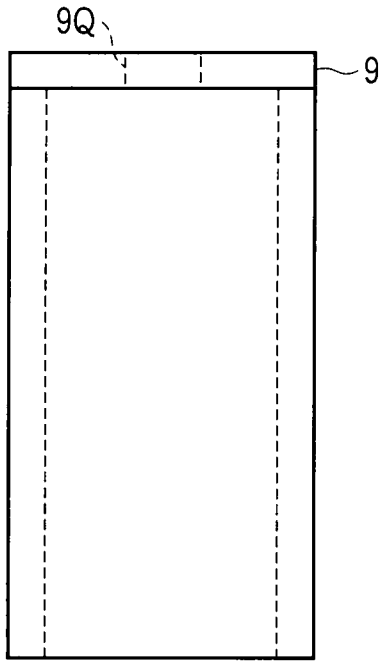
FIG. 4B is a front view of the vent tube shown in FIG. 4A.

In the second embodiment, a vent tube 9 having an orifice (aperture) 9Q through which heated steam passes is provided at the center of the region 5A for the perforations 5P of each of the low-pressure and intermediate-pressure condensers 1 and 2. FIGS. 4A and 4B are a top view and a front view of the vent tube 9.

Figure 5:
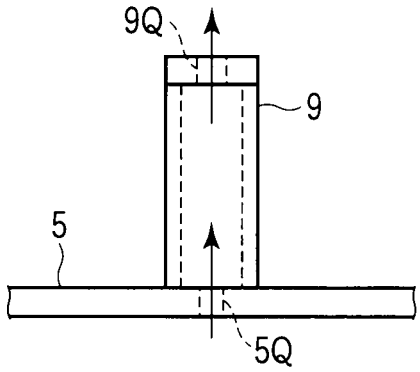
FIG. 5 is an illustration of the vent tube placed on a perforated plate.
Figure 6:
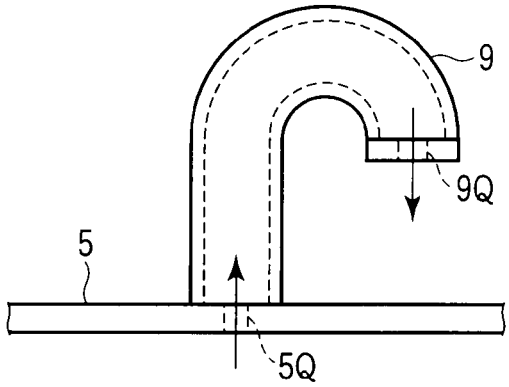
FIG. 6 is an illustration of a modification to the vent tube.

The vent tube 9 is located in the position of the above-described vent 5Q shown in FIG. 2. More specifically, as shown in FIG. 5, the vent tube 9 is located such that heated steam can flow into the vent tube 9 through the vent 5Q and flow out of the orifice 9Q. An umbrella for avoiding condensate can be provided above the orifice 9Q or, as shown in FIG. 6, the vent tube 9 can be partly U-shaped to prevent condensate from flowing into the orifice 9Q.

It is desirable that the shape and dimensions of the vent tube 9 including the bore of the orifice 9Q should be so determined that condensate and heated steam are mixed most efficiently. To determine the shape and dimensions, various parameters such as a difference in pressure between the upper and lower parts of the perforated plate 5 and an amount of heated steam are taken into consideration. Various types of vent tubes 9 having different dimensions such as the bore of the orifice 9Q can be prepared and one of them can be selected which allows condensate and heated steam to be mixed most efficiently.

According to the second embodiment, not only the same advantages as those of the first embodiment described above, but also the following advantages can be obtained. While heated steam is being guided into the vent tube 9Q from the high-pressure condenser 3, it is brought into enough contact with all the condensate dropping from the perforated plate 5, and the dimensions of the vent tube 9Q such as the bore of the orifice 9Q are set appropriately to promote a mixture of the heated steam and the condensate further.

THIRD EMBODIMENT

A third embodiment will be described below with reference to FIG. 7. In the third embodiment, the elements corresponding to those of the second embodiment shown in FIG. 3 are denoted by the same reference numerals and their descriptions are omitted, and elements different from those of the second embodiment will be described.

Figure 7:
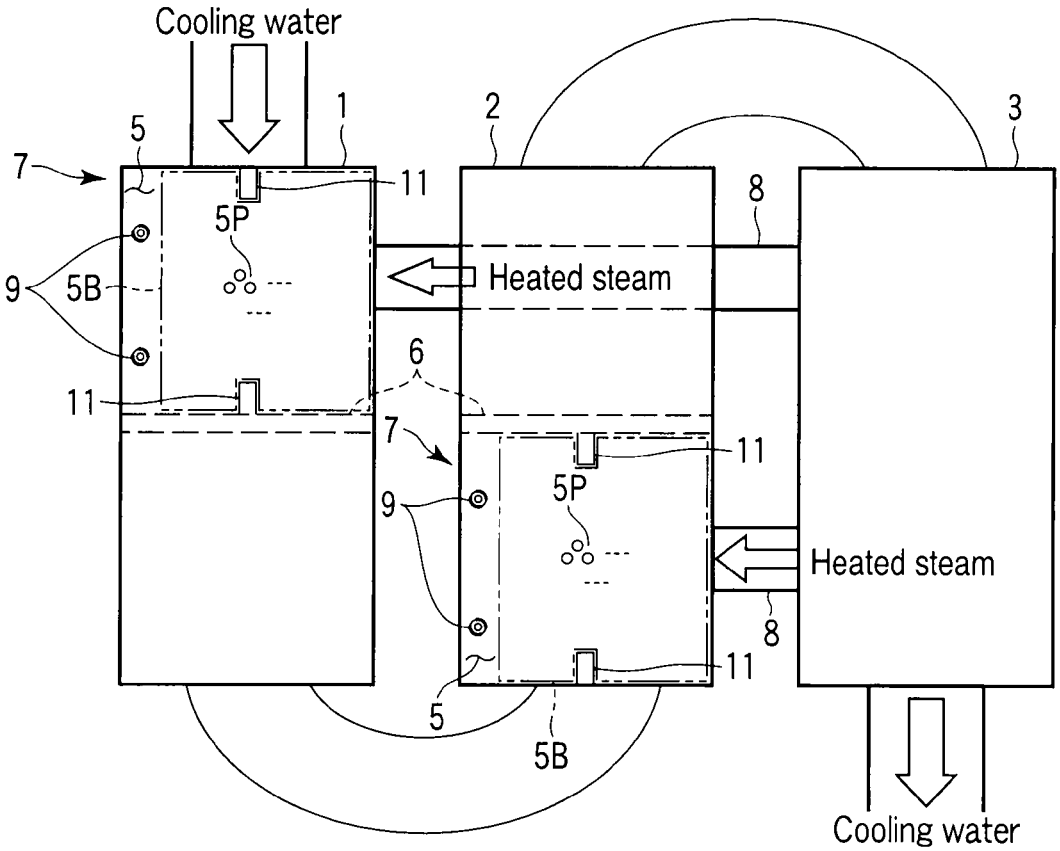
FIG. 7 is a top view of a multistage-pressure condenser according to a third embodiment.

FIG. 7 is a top view of a multistage-pressure condenser according to the third embodiment.

In the third embodiment, in each of the low-pressure and intermediate-pressure condensers 1 and 2, the vent tube 9 having an orifice 9Q is provided not at the center of perforations 5P on the perforated plate 5 but farthest from the heated steam inflow side. In this case, a single vent tube 9 can be provided or a plurality of vent tubes 9 can be provided. The perforations 5P are formed at regular intervals in a region 5B between the heated steam inflow side and the vent tube 9. The reheating room 7 includes a guide member 11 that prevents heated steam supplied from the high-pressure condenser 3 from passing both sides of the heating room 7. With this structure, the heated steam supplied from the high-pressure condenser 3 does not intensively flow to both sides of the heating room 7 but to the vent tube 9 through the inside of the heating room 7.

According to the third embodiment, not only the same advantages as those of the first embodiment described above, but also the following advantages can be obtained. Since the heated steam supplied from the high-pressure condenser 3 does not intensively flow to both sides of the heating room 7 but to the vent tube 9 through the inside of the heating room 7, it can be equally mixed with all the condensate.

FOURTH EMBODIMENT

A fourth embodiment will be described below with reference to FIGS. 8 and 9. In the fourth embodiment, the elements corresponding to those of the second embodiment shown in FIG. 3 are denoted by the same reference numerals and their descriptions are omitted, and elements different from those of the second embodiment will be described.

Figure 8:
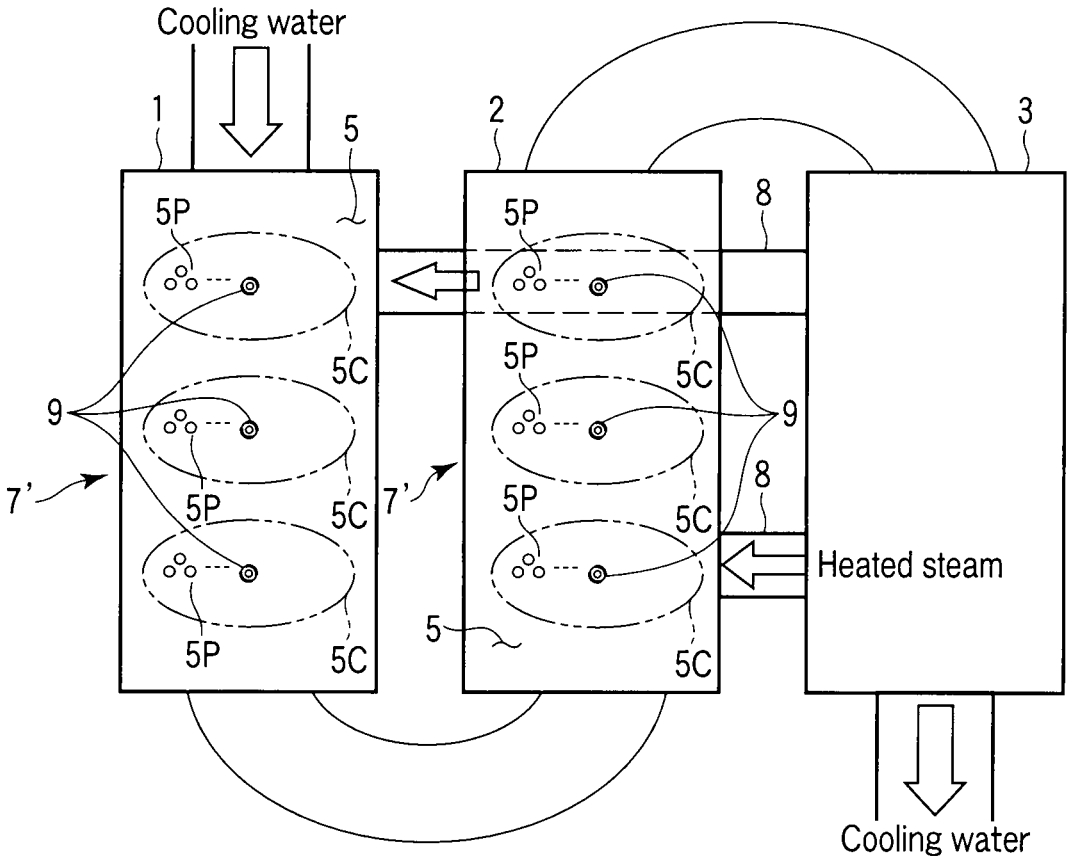
FIG. 8 is a top view of a multistage-pressure condenser according to a fourth embodiment.
Figure 9:
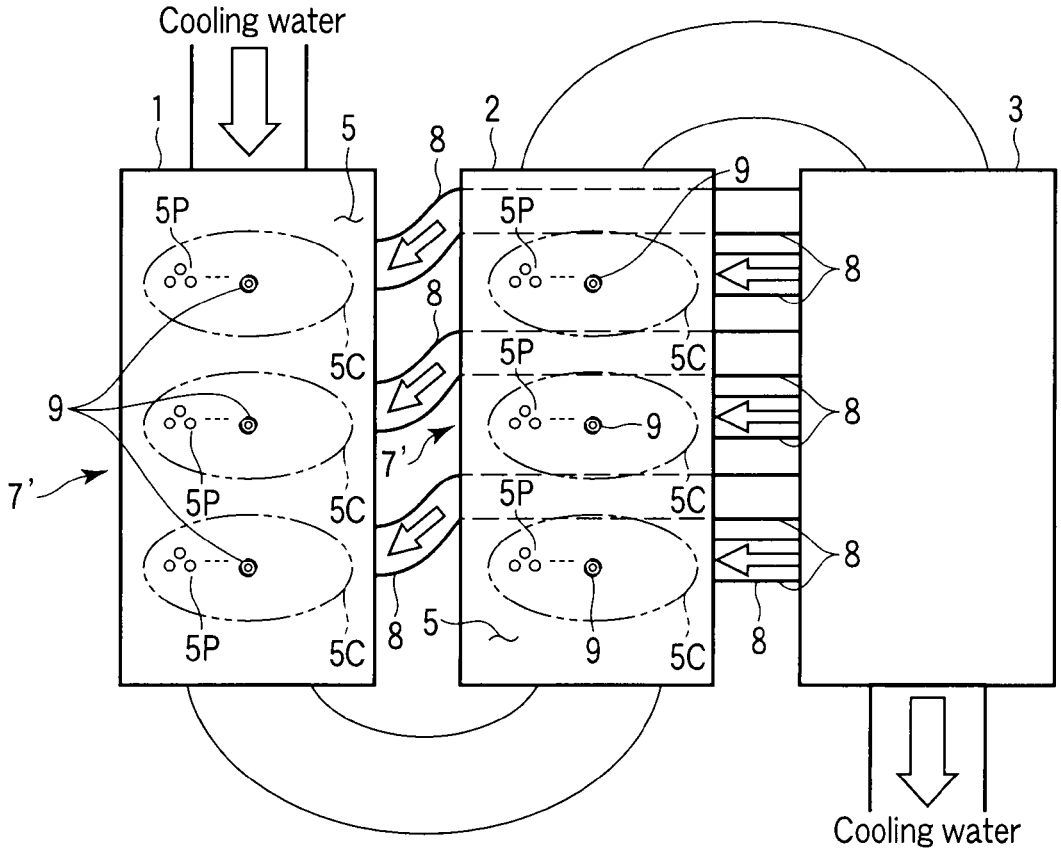
FIG. 9 is a top view of a modification to the multistage-pressure condenser shown in FIG. 8.

FIG. 8 is a top view of a multistage-pressure condenser according to the fourth embodiment.

In the fourth embodiment, neither of the low-pressure and intermediate-pressure condensers 1 and 2 includes a condensate partition for forming a reheating room, but a reheating room 7' is formed all over each of the condensers 1 and 2 in its horizontal direction. Each of the condensers 1 and 2 includes a perforated plate 5 in which perforations 5P are provided in each of a plurality of regions 5C separately. The vent tube 9 having an orifice 9Q is provided in the center of the perforations 5P of each of the regions 5C on the perforated plate 5.

The heating-steam flow path 8 for supplying heated steam from the high-pressure condenser 3 to the reheating room 7' is not limited to the structure shown in FIG. 8 but can be modified appropriately. In the structure shown in FIG. 8, there is only one heating-steam flow path 8 which extends from the high-pressure condenser 3 to the low-pressure condenser 1 through the intermediate-pressure condenser 2, and there is only one heating-steam flow path 8 which extends from the high-pressure condenser 3 to the intermediate-pressure condenser 2; however, in either case, three heating-steam flow paths 8 can be provided. If three heating-steam flow paths 8 are provided, it is desirable that they should extend, except under the regions 5C occupied by the perforations 5P in the intermediate-pressure condenser 2, as shown in FIG. 9, for example. With this structure, condensate dropping from the perforations 5P does not contact the heating-steam flow paths 8 thereby to prevent heated steam which flows through the heating-steam flow paths 8 from being cooled.

According to the fourth embodiment, while the internal structure of the multistage-pressure condenser is simplified, the same advantages as those of the second embodiment described above can be obtained.

The above first to fourth embodiments are directed to a multistage-pressure condenser having a three-body structure. However, the invention is not limited to such the multistage-pressure condenser but can be applied to a multistage-pressure condenser having a two-body structure or a multistage-pressure condenser having a four-or-more-body structure.

According to the embodiments described above, a multistage-pressure condenser can be provided which is capable of mixing condensate of a low-pressure condenser and heated steam supplied from a high-pressure condenser together while a structure for reheating is simplified.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A multistage-pressure condenser, comprising:

a first condenser, a second condenser and a third condenser, which are arranged in increasing order of internal pressure, the first condenser and the second condenser each including a first partition in which perforations from which condensate obtained by condensing turbine steam by cooling water drops are formed on a cooling water inflow side of the condenser rather than at a central part thereof, and a second partition which partitions a reheating room for reheating condensate dropping from the perforations in a direction perpendicular to an inflow direction of the cooling water; and a heating-steam flow path which supplies heated steam from the third condenser to the reheating room partitioned by the first partition and the second partition.

2. The multistage-pressure condenser according to claim 1, wherein the heating-steam flow path includes a flow path extending from the third condenser to the first condenser through the second condenser and a flow path extending from the third condenser to the second condenser.

3. The multistage-pressure condenser according to claim 2, wherein the reheating room in the second condenser and the heating-steam flow path that extends through the second condenser are provided in different spaces.

4. The multistage-pressure condenser according to claim 2, wherein the heating-steam flow path is inclined between the third condenser and the second condenser and between the second condenser and the first condenser.

5. The multistage-pressure condenser according to claim 1, wherein a vent through which heated steam passes is formed in a region occupied by the perforations on the first partition.

6. The multistage-pressure condenser according to claim 1, wherein a tube having an orifice through which heated steam passes is provided in a region occupied by the perforations on the first partition.

7. The multistage-pressure condenser according to claim 1, wherein a tube having an orifice through which heated steam passes is provided in a region farthest from the heated steam inflow side rather than at a center of the perforations on the first partition.

8. The multistage-pressure condenser according to claim 7, wherein the tube has a structure to prevent condensate from entering the orifice.

9. The multistage-pressure condenser according to claim 7, further comprising a member which prevents heated steam from passing both sides of the heating room.

* * * * *